United States Patent [19]

Harken

[11] Patent Number: 4,679,520

[45] Date of Patent: Jul. 14, 1987

[54] MAINSAIL REEFING AND FURLING DEVICE AND METHOD

[76] Inventor: Olaf T. Harken, 1251 Wisconsin Ave., Pewaukee, Wis. 53072

[21] Appl. No.: 742,917

[22] Filed: Jun. 10, 1985

[51] Int. Cl.[4] ..... B63H 9/04

[52] U.S. Cl. ..... 114/104

[58] Field of Search ..... 114/39, 97–98, 114/102–107

[56] References Cited

U.S. PATENT DOCUMENTS 308,146 11/1884 Fearon ..... 114/106
630,038 8/1899 Dresser ..... 114/105
639,916 12/1899 Achterberg ..... 114/105
2,197,654 4/1940 Beaudry ..... 114/107
4,449,468 5/1984 Schulz et al. ..... 114/97

FOREIGN PATENT DOCUMENTS 456664 3/1928 Fed. Rep. of Germany ..... 114/106

*Primary Examiner*—Jeffrey V. Nase
*Assistant Examiner*—Jesûs D. Sotelo
*Attorney, Agent, or Firm*—Gary, Juettner & Pyle

[57] ABSTRACT

A method and device for gathering a mainsail in a cavity within the boom as the sail is being lowered. The boom has a plurality of engaged rollers which draw in or let out the sail by tractive forces.

22 Claims, 5 Drawing Figures

MAINSAIL REEFING AND FURLING DEVICE AND METHOD

BACKGROUND OF THE INVENTION

This invention relates to sailing yachts and more particularly to apparatus and method for furling a mainsail, which is a sail supported along its luff by the mast and attached along its foot to the boom.

Many schemes have been devised for reefing or furling a mainsail, that is, either reducing the exposed area of he sail or stowing the sail when not in use. Unfortunately, certain features of mainsails make it difficult to find an easy solution. The sail is attached along its entire luff to the mast and along its entire foot to the boom. The sail also has spaced battens which extend inwardly from the rear edge or roach of the sail.

Prior devices for furling of a main involve systems in which the sail is rolled up into the mast, or around the luff, or is rolled up inside the boom, or around the foot. In the case of roller furling, however, a special sail without battens is required because the battens are less flexible than sail cloth and would interfere with furling. Other systems either require special sails, elaborate and expensive equipment, or require the participation of two or more people.

SUMMARY OF THE INVENTION

In the present invention, the mainsail is flaked or stuffed into a cavity in the boom. Opposed tractive means, such as resilient rollers, engage the fabric of the sail at the entrance of the cavity. The tractive rollers are geared to the main halyard winch. Thus, as the halyard is eased to lower the sail, the rollers engage the bottom portion of the sail and draw it into the boom cavity, thereby keeping the remaining exposed sail under control. Luff and leech cringles may be provided in the sail to allow reefing, or the entire sail may be furled within the boom.

Because the tractive rollers operate in conjunction with the halyard, the main may be reefed or furled by one person. Also, the resilient traction rollers allow sail battens in the sail to enter the mast cavity, even though they enter at an angle to the boom. Also, as the sail is furled, there is no need to fold or handle the sail, and there is no loose or bulky cloth exposed to the elements. A standard mainsail may be used with only minor modifications, and no costly modifications to the boat, other than replacement of the boom, are required.

THE DRAWING

FIG. 1 is side view of the upper portion of a sailing craft including the mast, mainsail and boom, and illustrating features of the present invention.

FIGS. 2, 3 4 and 5 are sectional views taken respectively along section lines 2—2, 3—3, 4—4 and 5—5 of FIG. 1.

DESCRIPTION OF THE PREFERRED EMBODIMENT

Figure 1:
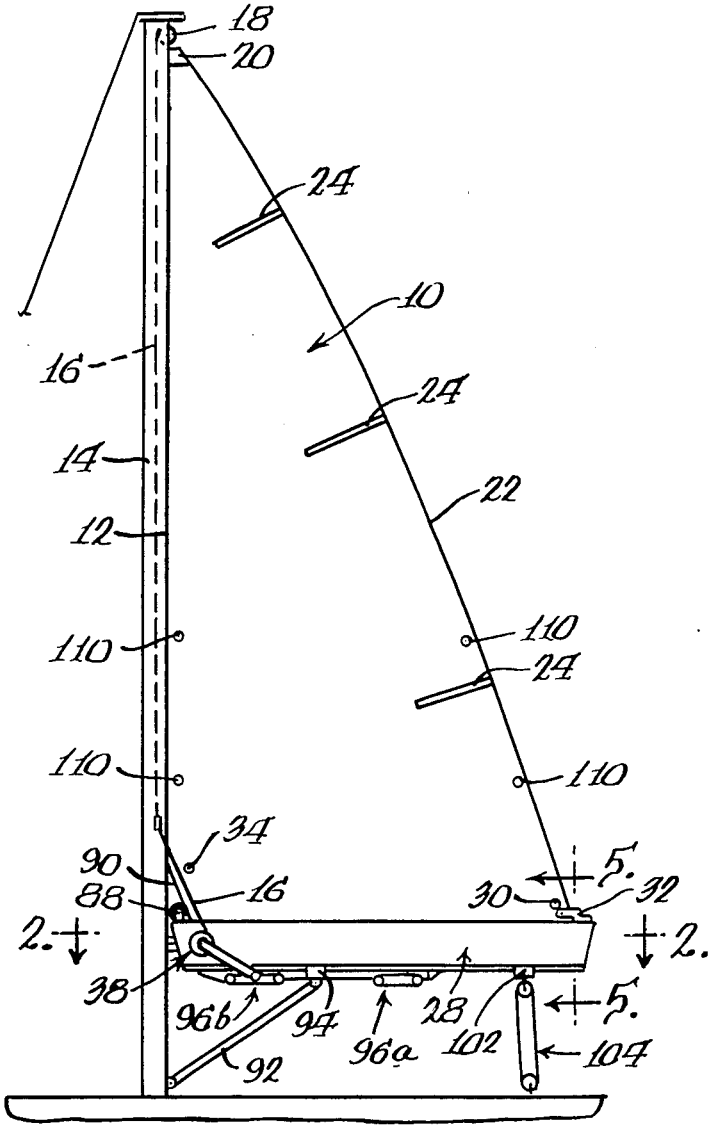

As shown in FIG. 1, a mainsail, generally indicated at 10, has a luff 12 supported by means of a bolt rope or the like in a slot extending the length of a spar or mast 14. A halyard 16 extends up through the mast 14 around pulley 18 and is attached to the head 20 of the mainsail, to enable raising and lowering of the sail in a conventional manner.

The mainsail 10, with the minor exception noted herein, is essentially of conventional construction and has a trailing edge or roach 22 and a plurality of spaced battens 24 extending inwardly from the roach and carried within pockets in the sail. The battens 24 are resilient strips of material that lend support to after portion or roach of the sail. The foot 26 (FIG. 4) of the sail is carried by a specially designed boom 28, which is pivotally connected to the mast. The clew 30 of the sail is attached to an outhaul car 32, which is slidably mounted on the boom 28 to adjust the tension on the foot of the sail. Tension on the luff 12 may be controlled by a conventional haul-down device (not shown) passing through a cunningham hole 34 near the tack of the sail.

As shown in FIGS. 1–5, the present invention contemplates the stowage of the mainsail into a cavity 36 within the boom 28. Unlike prior art devices, however, which serve to wind the sail around a horizontal axis, the apparatus of the present invention serves to stuff or flake the sail into the cavity 36. This is accomplished by tractive means located at the entrance of the boom cavity, which engage the sail along a substantially horizontal line at spaced locations and draw the sail into the cavity. The tractive means operate in conjunction with the halyard winch 38 such that the sail is drawn into and out of the cavity at substantially the same rate as the sail is being lowered and raised.

The boom 28 is somewhat wider and deeper than a conventional boom to provide a cavity 36 of sufficient volume to hold the sail 10 when completely furled. The boom may be made by extrusion methods and may include integral tracks and channels as herein described. It may be seen, for example, that a restricted groove 40 is provided along the bottom of the boom along the length thereof and opens into the cavity 36. The bolt rope 42 of the foot 24 of the sail is slidably engaged in the groove 40 to provide downward restraint for the sail. At the top of the boom 28, a pair of outwardly flared, spaced lips 44 extend longitudinally along the boom and open downwardly into the cavity 36 to provide an entrance and exit opening for the sail.

The halyard winch 38 is mounted on one side of the boom 28 preferably near the mast 14 such that the main halyard 16 may be raised and lowered. The winch 38 (FIG. 3) may be rotated by means of a handle 46. The winch drum 48 is secured to a splined shaft 50 which extends between opposed side walls of the boom 28 and is rotatably mounted in said walls by bearings 52 and 54.

The splined shaft 50 is operatively connected to a gear and furling mechanism within the boom, as shown in the drawings, and operation of the halyard winch also serves to operate the furling mechanism.

Figure 2:
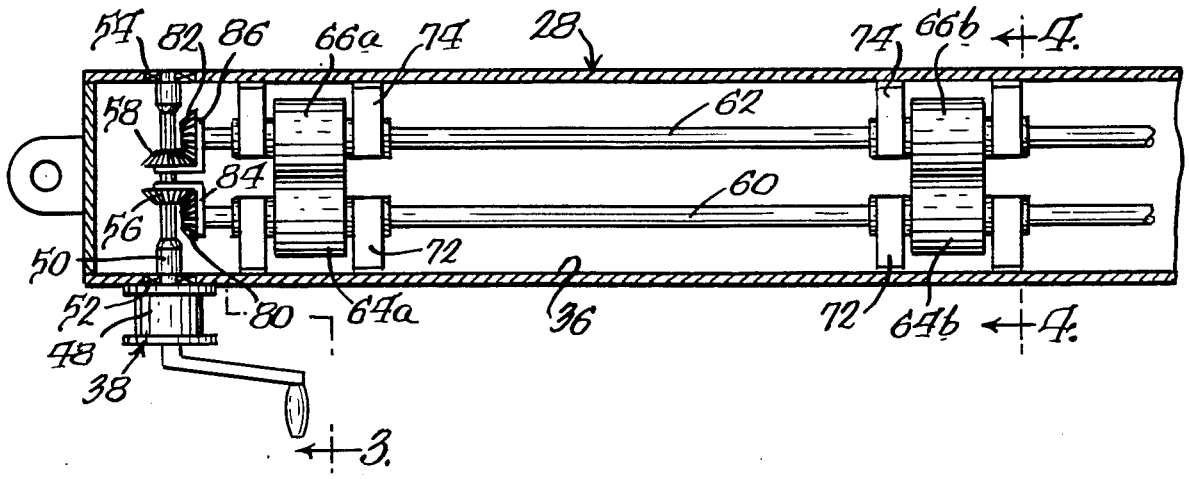
Figure 3:
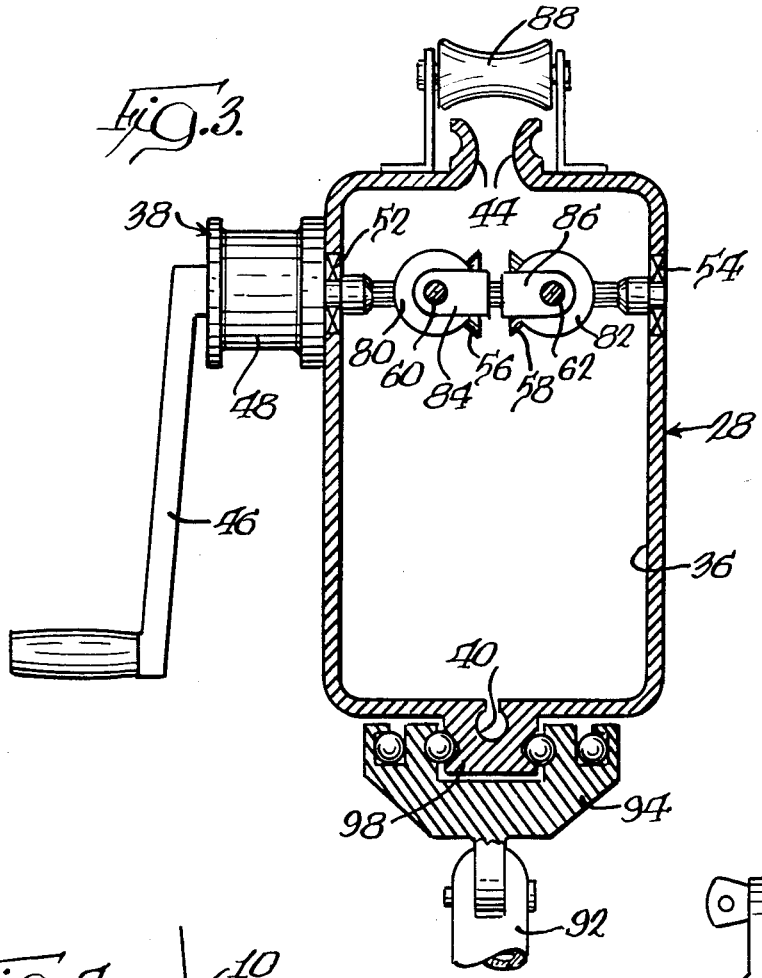

As shown in FIGS. 2 and 3, a pair of bevel gears 56 and 58 are axially slidably mounted in a spaced relation on the splined shaft 50 and rotate with the shaft irrespective of axial position of the gears thereon. The bevels of the respective gears 56 and 58 converge toward opposite respective side walls of the boom and are located in the upper forward portion of the boom cavity 36.

A pair of spaced parallel shafts 60 and 62 are mounted in the upper portion of cavity 36 and extend at right angles to shaft 50 along the length of the boom. A plurality of spaced rollers, such as 64*a*, 64*b* and 66*a*, 66*b*, are secured on the respective shafts 60 and 62 and rotate therewith. The rollers 64 and 66 are preferably composed of a compliant material such as an elastomer or elastic polymer, with rollers on respective shafts, such as 64*a* and 66*a* being tangentially engaged and defining nips below the opening at 44 into the top of the boom.

As shown in the drawings, the rollers 64, 66 preferably are of equal diameter and uniformly spaced along the foot of the sail, such that the nips of opposed rollers define a line along which the foot area of the sail is pulled and/or pushed into and out of the boom cavity. While the rollers are shown as having smooth, cylinder surfaces, other forms may be beneficially employed, such as rough or irregular surfaces, or interchanging surfaces such as gears and the like. Thus, the present invention contemplates the use of adhesive frictional or tractive engagement with the sailcloth for the purpose of furling.

Figure 4:
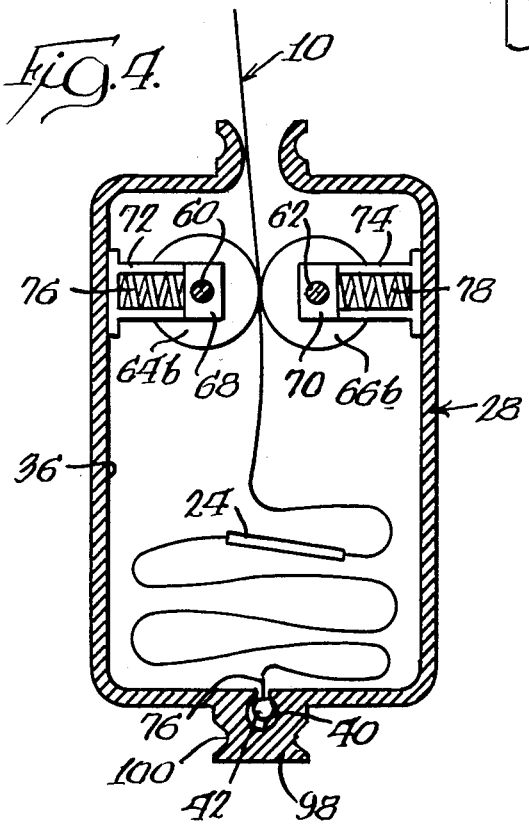

Means are provided for resiliently holding the opposed rollers 64 and 66 in engagement while permitting the shafts 60 and 62 and their associated rollers to move away from each other. As best shown in FIGS. 2, 3 and 4, a plurality of bushings such as 68 and 70 are mounted brackets 72 and 74 secured to and extending inwardly from the side walls of the boom. The bushings 68 and 70 are journaled on the shafts 60 and 62. In addition, means are provided for urging opposed bushings 68 and 70 and their respective shafts toward each other. For this purpose, the brackets may have a cylindrical pocket containing springs such as 76 and 78, said springs being under compression when the opposed rollers are engaged.

The foregoing feature is important in several respects. As the sail is furled, the battens 24 will encounter the rollers, usually at an angle thereto. Since the rollers are spring loaded, the springs may compress and allow an irregular thickness to pass through. Also, the springs 76 are selected to provide the desired compression at the nip of the rollers, in order to obtain the desired tractive force and also to prevent reverse slippage during furling in windy conditions.

The forward end of shafts 60 and 62 terminate in respective bevel gears 80 and 82, which taper forwardly and are in driving right angle engagement with the respective gears 56 and 58.

Upon rotation of the splined shaft 50, the gears 80 and 82 on shafts 60 and 62 are caused to rotate in opposite directions by the oppositely facing bevel gears 56 and 58. Thus, the opposed rollers 64 and 66 rotate toward each other during furling and away from each other when the sail is unfurled. The material of the sail is thus engaged in the nip of the rollers along a line near the top of the boom and is uniformly pulled by positive tractive forces either into or out of the cavity of the boom.

A pair of L-shaped followers or guides 84 and 86 are provided around the beveled gear assemblies. One end of guide 84, for example, is journaled on shaft 60 with the other and around shaft 50. Thus, as the shaft 60 and gear 80 are caused to move outwardly, the guide 80 pushes the gear 56 outwardly on the splined shaft 50, whereby the beveled gears remain in driving engagement. The gear 80 serves to push the gear 56 back in the opposite direction.

As shown in FIGS. 1 and 3, the top forward edge of the boom 28 is provided with a guide roller 88 for guiding the luff 12 or bolt rope of the sail rearwardly into the winch 38 as the luff is drawn out of the foot of the mast 14. In the preferred embodiment, the forward lower corners of the sail 10 near the tack may have a small triangular section removed at 90 to facilitate the initiation of the furling procedure.

During the furling procedure, it is necessary to ease the main halyard 16, which causes the boom to sag. Therefore, means are provided to support the boom along approximately a horizontal plane during the procedure. One method is to employ a conventional topping lift (not shown), which is a wire or line connected between the top of the mast and the outer end of the boom. Preferably, however, an adjustable vang is employed and comprises a rigid beam or tube 92 (FIG. 1) pivotally connected to the mast 14 near the deckline and extending upwardly and rearwardly toward the base of the boom 28. The other end is pivotally connected to a car 94 which is slidably mounted on the base of the boom. Suitable tackle 96*a* and 96*b* are mounted on the boom forward and aft of the car to slide the car in either direction. With the car moved forward, the boom is supported, and the arrangement functions as a topping lift. Pulling the car off lowers the boom, and the arrangement functions as a boom vang.

Figure 5:
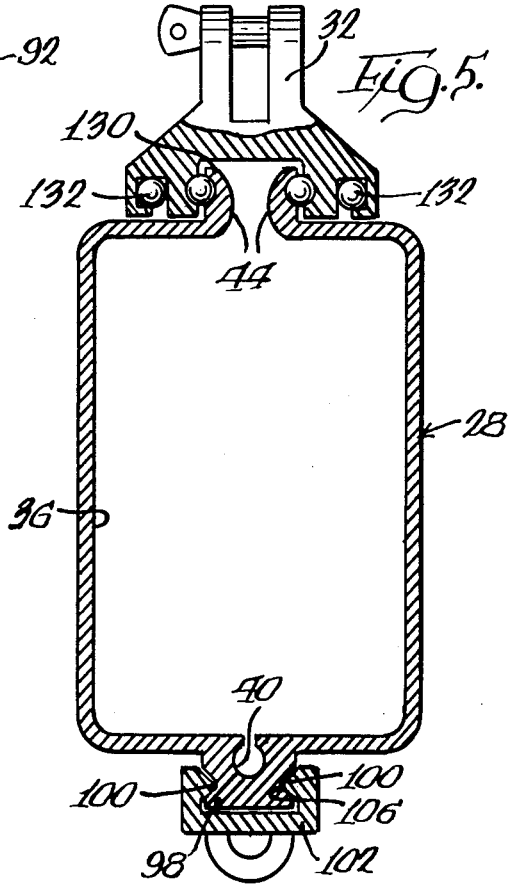

As show in FIGS. 3, 4 and 5, the base of the boom may comprise a projecting rib 98 extending the length of the boom. The rib may have opposed indentations 100 in the side thereof. This enables mounting of various sliding components, such as the vang car 94, which has recirculating ball bearings between the car and the indentations. Near the aft end of the boom, a slidable car 102 for the mainsheet system 104 is provided, said car having inner lugs 106 which engage the recesses of the rib.

As shown in FIGS. 3, 4 and 5, the lips 44 at the top opening in the boom may also be provided with external grooves 130 to enable slidable mounting of sail control gear. For example, as shown in FIG. 5, the outhaul car 32 may have pairs of lower pockets on both sides which contain respective sets of recirculating ball bearings 132 or other bearings. In the embodiment shown, the grooves 130 extend substantially the entire length of the boom. This allows the outhaul car 32 to move from an outermost position shown in FIG. 1 to an innermost position adjacent the mast 14.

From the foregoing, the operation of the furling system may be understood. In order to reef or furl the sail 10, the outhaul car 32 is released from the clew of the sail, and the halyard 16 is eased by unwinding the winch 38. This, in turn, causes the rollers on opposite shafts 60 and 62 to rotate toward each other, such that the sail is gripped by the rollers and progressively drawn into the cavity, as shown in FIG. 4. As the sail is furled, the battens will also enter the cavity but may enter the roller nips at an angle. To accommodate this, the spring loaded shafts 60 and 62 may move away from each other to allow passage of the battens. Due to the method of furling, the sail 10 tends to accumulate in the bottom of the cavity 36 in an alternatively folded or flaked configuration.

An important feature of the present invention is the automatic coordination of the halyard release and the furling rollers. The system is designed such that as the sail is lowered by slacking of the halyard, the rollers take up the slack at the bottom of the sail at the same rate. Thus, the diameter of the winch drum 48 is approximately equal to the diameter of the rollers. Preferably, however, the diameter of the winch drum 48 is slightly less than the diameter of the rollers, in the order of from about 2 to about 15 percent less. As a result, the rollers tend to draw the sail into the cavity at a slightly faster rate than the halyard is released, thereby to maintain tension in the body of the sail and to accommodate any slippage.

In order to reef the sail while sailing, the sail may have luff and leech cringles 110 at each reefing level up the sail. The sail is lowered until the desire cringle is reached and is then reattached at the tack and clew.

While it is desirable to do so, it is not essential that movement of halyard always be associated with movement of the tractive rolls. For example, if the sail is to be complete furled, the halyard 16 may be eased by hand, and the winch 38 may be rotated in the furling direction to gather in the sail. Use of the single winch 38 to control both the halyard and furling rollers, however, greatly facilitates the furling operation and allows the procedure to be performed by one person.

I claim:

1. A device for furling a mainsail supported between a mast and a boom, said device comprising an opening for said sail along the top of the boom, a cavity within the boom for receiving the furled portion of the sail, and tractive means in frictional engagement with opposite sides of the sail along said boom for pulling said sail through said opening and into said cavity.

2. The device of claim 1 wherein said tractive means comprise a plurality of opposed compliant rollers in engagement with the sail, and means for rotating the rollers in opposite directions.

3. The device of claim 2 wherein means are provided to urge said opposed rollers toward each other.

4. The device of claim 2 wherein said opposed rollers are mounted respective shafts within the cavity of the boom.

5. The device of claim 4 wherein the means for rotating said comprises means for rotating said shafts.

6. The device of claim 5 wherein the means for shafts comprises a winch on the boom.

7. The device of claim 6 wherein the means for rotating said shafts further comprises gear means between said winch and said shafts.

8. The device of claim 6 wherein said winch is also connected to a halyard for lowering the sail.

9. The device of claim 4 wherein means are provided within said boom cavity for rotatably mounting said shafts in parallel.

10. The device of claim 1 wherein a halyard is provided for lowering said sail, and wherein said tractive means operate in cooperation with said halyard.

11. The device of claim 1 wherein said opening comprises a pair of spaced lips extending upwardly from the boom, and an outhaul car slidably mounted on said lips.

12. The device of claim 1 wherein means are provided for supporting the boom during furling, said means comprising an elongated support member, one end of the support member being pivotally connected to the mast beneath the boom, the other end being slidably adjustable along the boom.

13. The device of claim 12 wherein said other end is pivotally connected to a car, said car being slidably mounted on the bottom of the boom.

14. A device for furling a mainsail supported between a mast and a boom, said device comprising a boom having a cavity therein beneath the sail, means for securing the foot of the sail at the bottom of the cavity, a halyard connected to the head of the sail for raising and lowering the sail, an opening in the top of the boom for receiving the sail, tractive means beneath said opening and within said cavity for applying a downward frictional force and pulling the body of the sail into and out of the cavity, and winch means conjointly operating said halyard and said tractive means, whereby the sail is drawn into and out of the cavity, respectively, as said sail is lowered and raised by said halyard.

15. The device of claim 14 wherein said tractive means comprises a pair of rotatable shafts mounted beneath said opening on either side thereof, and a plurality of opposed rollers secured on said shafts, said opposed rollers being in tangential engagement.

16. The device of claim 15 wherein means are provided for resiliently urging said rollers into engagement.

17. The device of claim 15 further comprising gear means between said winch means and said shafts for rotating said shafts in opposite directions.

18. The device of claim 14 wherein vang means is provided for supporting said boom during the furling.

19. The device of claim 14 wherein the halyard and the tractive means are operated at substantially the same speed.

20. The device of claim 19 wherein said tractive means are operated at a faster speed than the halyard.

21. A method for furling a mainsail, having a luff slidably mounted in a mast, and a foot carried in a boom, together with a halyard connected to the head of the sail for raising and lowering the sail on the mast, said method comprising the steps of lowering the sail by easing the halyard, and at the same time, gathering the sail at the foot by applying downward frictional force on the body of the sail along a line substantially parallel to the boom, and depositing the gathered portion of the sail beneath said line in a cavity in the boom.

22. The method of claim 21 wherein the sail is gathered at a faster rate than the sail is lowered.

* * * * *